US008443841B2

(12) United States Patent
Wellner et al.

(10) Patent No.: US 8,443,841 B2
(45) Date of Patent: May 21, 2013

(54) GUIDING DEVICE FOR A METAL BELLOWS

(75) Inventors: Marc Wellner, Gams (CH); Herbert Baltes, Losheim (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 419 days.

(21) Appl. No.: 12/452,941

(22) PCT Filed: Apr. 5, 2008

(86) PCT No.: PCT/EP2008/002728

§ 371 (c)(1),
(2), (4) Date: Mar. 17, 2010

(87) PCT Pub. No.: WO2009/015705

PCT Pub. Date: Feb. 5, 2009

(65) Prior Publication Data

US 2010/0186843 A1 Jul. 29, 2010

(30) Foreign Application Priority Data

Aug. 1, 2007 (DE) ..... 10 2007 036 487

(51) Int. Cl.
*F16L 55/04* (2006.01)

(52) U.S. Cl.
USPC ..... 138/30

(58) Field of Classification Search
USPC ..... 138/30
See application file for complete search history.

(56) References Cited

U.S. PATENT DOCUMENTS

| | | | | |
|---|---|---|---|---|
| 2,365,994 | A | 12/1944 | Ashton | |
| 4,997,009 | A * | 3/1991 | Niikura et al. | 138/30 |
| 6,286,552 | B1 * | 9/2001 | Shimbori et al. | 138/31 |
| 6,478,051 | B1 * | 11/2002 | Drumm et al. | 138/30 |
| 6,525,290 | B2 * | 2/2003 | Shimbori et al. | 219/91.23 |
| 2001/0037834 | A1 * | 11/2001 | Shimbori et al. | 138/31 |
| 2006/0037658 | A1 * | 2/2006 | Shimbori et al. | 138/30 |
| 2012/0211111 | A1 * | 8/2012 | Baltes | 138/30 |

FOREIGN PATENT DOCUMENTS

| | | | |
|---|---|---|---|
| EP | 0 391 320 | A1 | 10/1990 |
| EP | 1 052 412 | A2 | 11/2000 |
| EP | 1 160 460 | A2 | 12/2001 |
| FR | 2 156 489 | | 6/1973 |
| JP | 02 113139 | A | 4/1990 |
| JP | 02 195001 | A | 8/1990 |
| JP | 10 19001 | A | 1/1998 |

* cited by examiner

*Primary Examiner* — James Hook
(74) *Attorney, Agent, or Firm* — Roylance, Abrams, Berdo and Goodman LLP

(57) ABSTRACT

A guiding device for a metal bellows (3), on at least one bellows end (37) movable along the wall of a housing (10) during the expansion and contraction of the bellows (3). A guiding element is provided between the end body and the housing (10). The guiding element is formed by a plurality of separate guiding bodies (49) disposed in intervals from each other on the circumference of the end body (39).

20 Claims, 2 Drawing Sheets

GUIDING DEVICE FOR A METAL BELLOWS

FIELD OF THE INVENTION

The invention relates to a guiding device for a metal bellows. On at least one end of the bellows, an end body can be moved along the wall of a housing at least when the bellows expands and contracts. A guiding element is provided between the end body and the housing.

BACKGROUND OF THE INVENTION

Metal bellows are used in various technical domains as a component of variable length, for example, when necessary to equalize length in lines or coupling connections for flowable media. Metal bellows are also common in hydraulic accumulators as a movable separating element between the gas side and fluid side. Especially in applications in which relatively extensive movements take place during expansion and contraction of the bellows, it is important for the service life of the bellows that the respective end of the bellows moved along a housing wall in operation is reliably guided.

As shown from EP 1 052 412 A2, the prior art with respect to the present invention includes providing a guiding element on the movable end of the bellows. In the known solution the movable end body of the bellows is a sealing body for a hydraulic accumulator. Within the accumulator housing, the bellows separates the gas side from the fluid side. The guiding element is a guide ring surrounding the outside periphery of the sealing body and forming an external sliding surface movable along the inside wall of the accumulator housing.

This known solution is disadvantageous in several respects. On the one hand, production is complex because the guide ring is L-shaped in cross section and is fixed on the outer periphery of the sealing body by welding. On the other hand, corresponding production efforts due to the guide ring have to be provided with a series of openings allowing passage of media during the axial movements of the sealing body.

SUMMARY OF THE INVENTION

An object of the invention is to provide a guiding device characterized by comparison by a simpler construction enabling especially economical production.

According to the invention, this object is basically achieved by a guiding device not being a guide ring extending over the entire periphery of the end body of the bellows, but being several separate guide bodies. The mutual distances of the guide bodies from one another obviates the necessity of providing openings for passage of media. In contrast to a guide ring extending over the entire length of the periphery, the invention also saves weight improving response behavior since the expansion and contraction movements of the bellows are counteracted by a lower mass inertia. Moreover, operating behavior is also improved by guidance taking place with reduced friction.

The invention is especially suited for applications in which the end body is a sealing body tightly sealing the interior of the bellows on one end, i.e., for applications in which the expansion and contraction of the bellows lead to changes in the volume of the pertinent medium spaces.

In these applications the sealing body can be cup-shaped and can have a circular ring-shaped peripheral edge overlapping the pertinent end of the bellows and connected to a circular cylindrical side wall of the cup extending into the interior of the bellows. The guide bodies can be formed by guide shoes having cross section a U-shaped profile, and overlapping the peripheral edge of the cup, with one profile leg at a time forming a sliding surface on the housing wall. These embodiments are characterized by especially simple production and assembly because the guide shoes, by overlapping the peripheral edge of the cup forming the sealing body and due to their elasticity, can be clamped to the peripheral edge in the manner of a clip, and can be catch elements for the formation of interlocking.

Preferably, the guide shoes are formed by a plastic material with good sliding properties. A lightweight construction resulting can be easily produced by injection molding.

In especially advantageous embodiments, the sealing body of the bellows is a movable separating element between the gas side and fluid side of a hydraulic accumulator. The guide bodies are used as sliding bodies be movable lengthwise along the inside wall of the accumulator housing. Due to the configuration of the guiding device according to the invention this hydraulic accumulator is characterized by especially favorable operating behavior.

In especially preferred embodiments, one end of the bellows is fixed on the bottom plate of the accumulator housing having an opening for fluid entry into the interior of the bellows. The sealing body located on the movable bellows end defines within the accumulator housing the respective volumes of the gas side and fluid side. The fluid side is located within the bellows according to the motion during the expansion and contraction of the bellows. The bottom of the cup forming the sealing body can especially advantageously have an annular rib projecting on the inside of the bellows into the interior of the fluid space. When the bellows are completely contracted, an end position limit interacts with a contact and centering arrangement on the bottom plate of the accumulator housing. In this way, the cup is used as the sealing body is guided not only during the motion along the accumulator housing, but travels into a defined end position centered in the housing upon contraction.

Advantageously, the contact and centering arrangement can have an annular groove recessed in the bottom plate. The annular groove for interaction with the annular rib of the cup, receives an elastomer gasket. The rib adjoins the gasket in the end position of the bellows. A metallic centering ring is also held in the annular groove and has an oblique centering surface against which the annular rib of the cup engages when travelling into the end position. As is detailed below in the description using the drawings, the elastomer gasket in interaction with the annular rib of the cup also forms an end position damping, while the slant of the centering ring causes orientation into the end position.

The subject matter of the invention is also a hydraulic accumulator with an accumulator housing in which the movable separating element between the gas side and the fluid side is a metal bellows. The metal bellows has a guiding device according to the invention.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
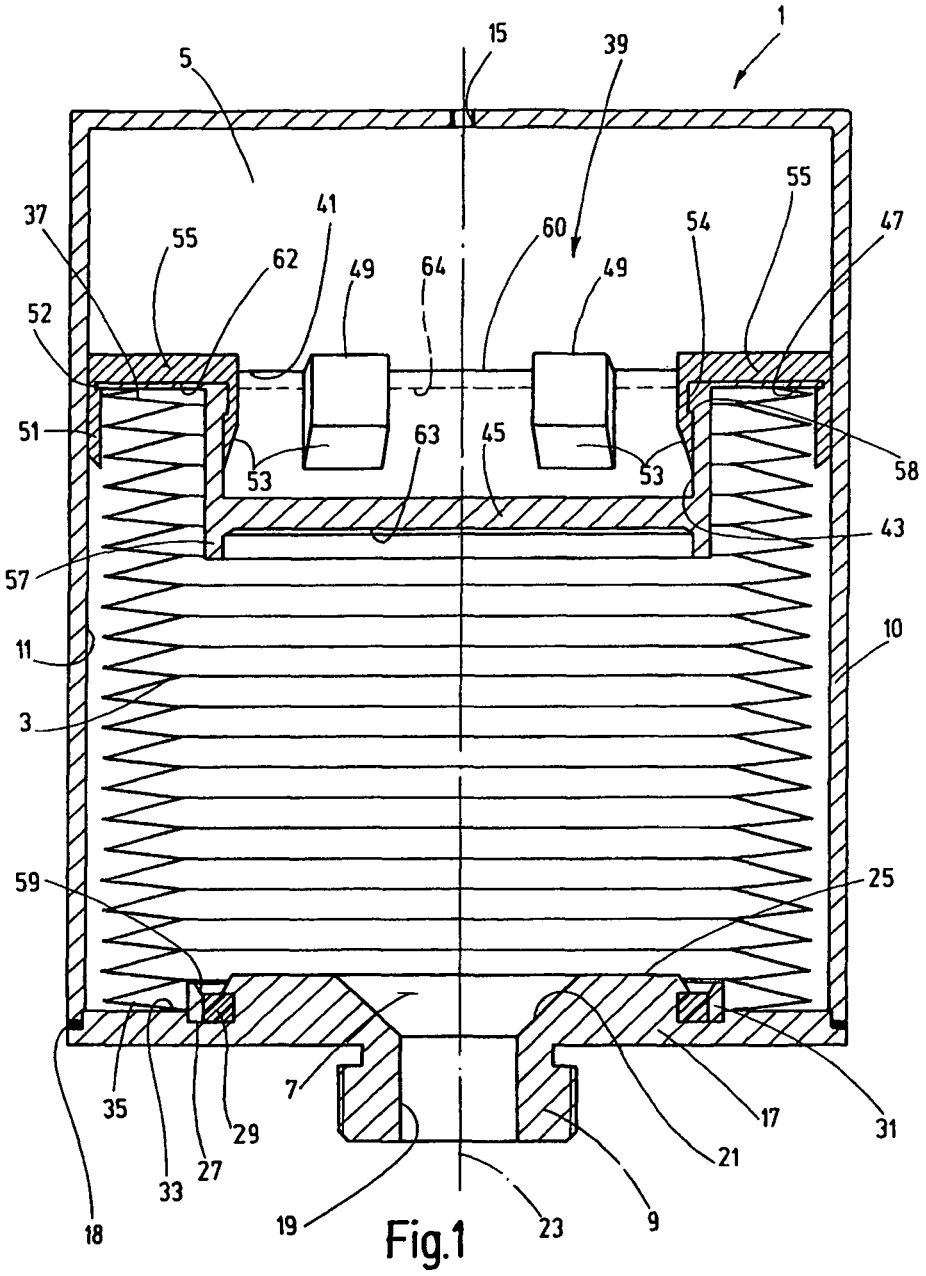
FIG. 1 is a side elevational view in section of a hydraulic accumulator depicted schematically highly simplified, with a metal bellows used as the movable separating element between the gas side and fluid side, provided with a guiding device according to one exemplary embodiment of the invention.

The invention is explained below using an application example in which a hydraulic accumulator 1 has a metal bellows 3 in the interior of its accumulator housing forming a movable separating element between the gas side 5 holding a working gas and a fluid side 7. The fluid side 7 is connected to the fluid port 9 for supply of the pertinent working fluid (usually hydraulic oil). The accumulator housing itself in at least the section of length in which motion of the bellows 3 takes place during expansion and contraction, forms a hollow circular cylinder 10. The inner wall 11 of the cylinder 10 interacts with the guiding device of the metal bellows 3 to guide the bellows during expansion and contraction. The end of the accumulator housing forming the gas side 5 has the fill port 15 for a working gas, such as $N_2$.

The end of the accumulator housing having a fluid port 9 has a circular bottom plate 17 with peripheral edge 18 welded to the end edge of the hollow cylinder 10. The bottom plate 17 has a central through opening 19 providing access from the fluid port 9 to the fluid side 7 in the interior of the metal bellows 3. On the opening 19, a bevel 21 widens the opening to the inside for flow optimization. The top of the bottom plate 17 facing the fluid side 7 is not flat, but in the region bordering the opening 19 forms the greatest thickness with an annular surface 25 concentric to the axis 23. The annular surface radially outer edge is connected to a depression with an annular groove 27 receiving an elastomer gasket 29 and a metallic centering ring 31. In the radial direction farther outside of the annular groove 27, the bottom plate 17 has a weld spot 33 for the end 35 of the metal bellows 3 welded fluid-tight. The metallic intermediate ring 31 keeps the elastomer gasket 29 in its installation position shown in FIG. 1. Gasket 29 forms stop damping for parts of the bellows 3.

The top end 37 of the metal bellows 3 has its interior closed fluid-tight by a sealing body 39. The sealing body 39 is cup-shaped such that its circular ring-shaped peripheral edge 41 defines a radial plane perpendicular to the axis 23 and is connected to the cup part lying radially farther to the inside. The circularly cylindrical side wall 43 of the cup projects into the interior of the metal bellows 3. When the sealing body 39 reaches its end position shown in FIG. 1, with the bellows 3 fully expanded, for the gas side 5 a residual volume remains increased by the interior of the cup. The side wall 43 is connected by the cup bottom 45 which bottom is flat in the interior of the cup. On the bottom 64 of the peripheral edge 41 bordering the end of the bellows weld spot 47 defines the welding line for a tight weld to the pertinent end 37 of the bellows 3 and is made analogously to the weld spot 33 on the bottom plate 17.

The guide bodies for guiding the movable end 37 of the bellows 3 are guide shoes 49 injection molded from a plastic material with good sliding properties. As is apparent from the drawings, especially from FIG. 2, the guide shoes 49 for the most part have a short U-profile shape and are arranged distributed around the peripheral at regular intervals on the sealing body 39, overlapping its peripheral edge 41. In the illustrated embodiment, six guide shoes 49 are provided. Each guide shoe 49 has a profile leg 51 with an arch concentric to the axis 23. This profile leg 51 forms one sliding surface at a time for contact with the inside wall 11 of the housing cylinder 10, and profile leg 51 is connected to the inner profile leg 53 via a crosspiece 55 overlapping the peripheral edge 41 of the sealing body 39. The crosspieces 55 do not extend above the annular surface 60 of the peripheral edge 41 defining the upper radial plane, but sit in depressions 62 which are made appropriately for the guide shoes 49 in the peripheral edge 41 and reduce the material thickness of the peripheral edge 41 between its bottom 64 and the annular surface 60 in regions to form a seat for the pertinent guide shoe 49. They are locked in the depressions 62 not only against displacement in the peripheral direction, but are also secured against lifting in the axial direction. For this purpose, on the insides of the profile legs 51 and 53 have catch notches 52 and 54, respectively. When the guide shoes 49 are slipped onto the peripheral edge 41, inner catch shoulders 58 made on the elastic profile legs 51, 53 interlock with the catch notches 52 and 54 in the manner of clips.

Figure 2:
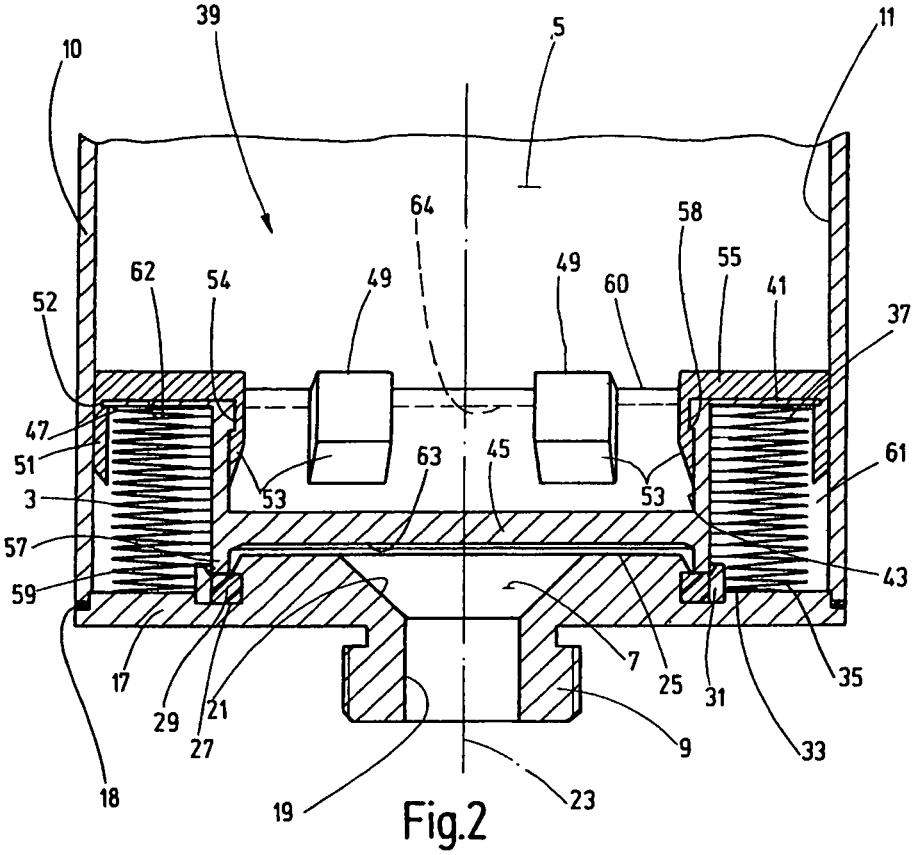
FIG. 2 is a partial side elevational view in section depicted schematically highly simplified, of only the bottom area of the accumulator of FIG. 1 having the fluid port with the metal bellows being completely contracted.

Besides the guidance of the movable end 37 of the bellows 3 formed by the guide shoes 49, on the bottom plate 17 has additional shaping for guidance and centering in the completely contracted position of the bellows 3, see FIG. 2, to position the cup bottom 45. Cup bottom 44, on its bottom surface facing the bottom plate 17, has a peripheral projecting annular edge 57. Upon approaching the end position shown in FIG. 2, annular edge 57 is guided on the slanted surface 59 of the centering ring 31 to travel into the centered position resting on the elastomer gasket 29. The elastomer gasket 29 acts a buffer attenuating contact noise and seals the fluid entry region on the opening 19 of the bottom plate 17 relative to the residual fluid chamber 61 remaining on the inside of the bellows 3. The residual volume of the incompressible fluid located in the chamber 61 additionally contributes to end position damping. The guide shoes 49 are preferably formed from a plastic material such as polytetrafluorethylene (PTFE), having good sliding properties and being resistant both to wear and temperature.

As shown in from FIG. 2, the underside of the cup bottom 45 located within the annular edge 57 is not flat, but has a pattern of grooves 63 of small depth. In the end position the bottom 45 then does not form a fluid-tight seal on the edge of the opening 19 but provides a remaining passage for the residual fluid at that location.

While one embodiment has been chosen to illustrate the invention, it will be understood by those skilled in the art that various changes and modifications can be made therein without departing from the scope of the invention as defined in the appended claims.

What is claimed is:

1. A guiding device, comprising:

a housing having a housing wall;

a metal bellows movably mounted in said housing and having an end body movable along said housing wall as said metal bellows expands and contracts, said end body having a cup-shaped sealing body tightly sealing an interior of said bellows on a movable end thereof and having a ring-shaped peripheral edge overlapping said movable end of said bellows and connected to a circular cylindrical side wall of said sealing body extending into said interior of said bellows; and a guiding element having a plurality of separate guide shoes located distances from one another on said peripheral edge of said sealing body, each said guide shoe having a U-shaped profile in cross section, overlapping said peripheral edge of said sealing body, and having first and second profile legs, each said first profile leg having a sliding surface slidably engaging said housing wall.

2. A guiding device according to claim 1 wherein a catch notch is provided on an inside surface of at least one of said profile legs at each said guide shoe forming a clip locking of each said guide shoe on said peripheral edge with a catch shoulder on one of said side wall of said sealing body and an outer periphery of said peripheral edge.

3. A guiding device according to claim 1 wherein said guide shoes are formed on plastic material with good sliding properties.

4. A guiding device according to claim 1 wherein said sealing body is a movable separating element between a gas side and a fluid side in said housing to form an accumulator.

5. A guide device according to claim 4 wherein a bottom plate is fixed on a fixed end of said bellows opposite said movable end thereof and has an opening therein for fluid entry into said interior of said bellows, said sealing body defining respective volumes of said gas side and said fluid side according to expansion and contraction movements of said bellows.

6. A guiding device according to claim 5 wherein said sealing body has a bottom having an annular rib projecting into said fluid side inside said bellows; and said bottom plate has a centering arrangement interacting and contacting said annular rib when said bellow is contracted to an end position thereof.

7. A guiding device according to claim 6 wherein said centering arrangement comprises an annular groove recessed in said bottom plate receiving said annular rib in the end position, an elastomeric gasket in said annular groove adjoining said annular rib in the end position and a metallic ring in said annular groove having an oblique centering surface engaging said annular rib as said sealing body moves into the end position.

8. A guiding device according to claim 1 wherein said sealing body has a bottom surface facing said interior of said bellows and having at least one groove-shaped depression.

9. A hydraulic accumulator, comprising:

a housing having a housing wall, a gas side and a fluid side;

a metal bellows movably mounted in said housing, separating said gas side and said fluid side and having an end body movable along said housing wall as said metal bellows expands and contracts, said end body having a cup-shaped sealing body tightly sealing an interior of said bellows on a movable end thereof, said sealing body including a bottom having an annular rib projecting into said fluid side inside said bellows; and a guiding element having a plurality of separate guide shoes located distances from one another on a periphery of said sealing body, a bottom plate on a fixed end of said bellows having a centering arrangement interacting and contacting said annular rib when said bellow is contracted to an end position thereof, said centering arrangement including an annular groove recessed in said bottom plate receiving said annular rib in the end position, an elastomeric gasket in said annular groove adjoining said annular rib in the end position and a metallic ring in said annular groove having an oblique centering surface engaging said annular rib as said sealing body moves into the end position.

10. A hydraulic accumulator according to claim 9 wherein a catch notch is provided on an inside surface of at least one of said profile legs at each said guide shoe forming a clip locking of each said guide shoe on said peripheral edge with a catch shoulder on one of said side wall of said sealing body and an outer periphery of said peripheral edge.

11. A guiding device according to claim 9 wherein said guide shoes are formed on plastic material with good sliding properties.

12. A hydraulic accumulator according to claim 9 wherein said bottom plate is fixed on said fixed end of said bellows opposite said movable end thereof and has an opening therein for fluid entry into said interior of said bellows, said sealing body defining respective volumes of said gas side and said fluid side according to expansion and contraction movements of said bellows.

13. A hydraulic accumulator according to claim 9 wherein said sealing body has a bottom surface facing said interior of said bellows and having at least one groove-shaped depression.

14. A hydraulic accumulator, comprising:

a housing having a housing wall, a gas side, a fluid side, a gas inlet and a fluid port;

a metal bellows movably mounted in said housing, separating said gas side and said fluid side and having an end body movable along said housing wall as said metal bellows expands and contracts, said end body having a cup-shaped sealing body tightly sealing an interior of said bellows on a movable end thereof and having a ring-shaped peripheral edge overlapping said movable end of said bellows and connected to a circular cylindrical side wall of said sealing body extending into said interior of said bellows; and a plurality of separate guide shoes located distances from one another on said peripheral edge of said sealing body, each said guide shoe having a U-shaped profile in cross section, overlapping said peripheral edge of said sealing body, and having first and second profile legs, each said first profile leg having a sliding surface slidably engaging said housing wall.

15. A hydraulic accumulator according to claim 14 wherein a catch notch is provided on an inside surface of at least one of said profile legs at each said guide shoe forming a clip locking of each said guide shoe on said peripheral edge with a catch shoulder on one of said side wall of said sealing body and an outer periphery of said peripheral edge.

16. A hydraulic accumulator according to claim 14 wherein said guide shoes are formed on plastic material with good sliding properties.

17. A hydraulic accumulator according to claim 14 wherein a bottom plate is fixed on a fixed end of said bellows opposite said movable end thereof and has an opening therein for fluid entry into said interior of said bellows, said sealing body defining respective volumes of said gas side and said fluid side according to expansion and contraction movements of said bellows.

18. A hydraulic accumulator according to claim 17 wherein said sealing body has a bottom having an annular rib projecting into said fluid side inside said bellows; and said bottom plate has a centering arrangement interacting and contacting said annular rib when said bellow is contracted to an end position thereof.

19. A hydraulic accumulator according to claim 18 wherein said centering arrangement comprises an annular groove recessed in said bottom plate receiving said annular rib in the end position, an elastomeric gasket in said annular groove adjoining said annular rib in the end position and a metallic ring in said annular groove having an oblique centering surface engaging said annular rib as said sealing body moves into the end position.

20. A hydraulic accumulator according to claim 14 wherein said sealing body has a bottom surface facing said interior of said bellows and having at least one groove-shaped depression.

* * * * *